US005343600A

United States Patent [19]

Peykar

[11] Patent Number: 5,343,600

[45] Date of Patent: Sep. 6, 1994

[54] WORN LOOK CARPET WEAVE

[76] Inventor: Alexander Peykar, 100 Park Plaza Dr., Secaucus, N.J. 07094

[21] Appl. No.: 987,792

[22] Filed: Dec. 9, 1992

[51] Int. Cl.[5] ..... D03D 29/00; D03D 3/00

[52] U.S. Cl. ..... 28/143; 28/151; 139/34; 139/18

[58] Field of Search ..... 139/18, 20, 34, 29; 28/143, 151, 152; 289/1.5

[56] References Cited

U.S. PATENT DOCUMENTS

| | | | |
|---|---|---|---|
| Re. 30,656 | 6/1981 | Davitian | 28/151 |
| 1,503,904 | 8/1924 | Lloyd | 139/18 |
| 2,186,692 | 1/1940 | Boyer et al. | 139/34 |
| 2,199,515 | 5/1940 | Woods | 139/34 |
| 2,474,904 | 7/1949 | Mazzella | 139/34 X |

FOREIGN PATENT DOCUMENTS

| | | | |
|---|---|---|---|
| 1003305 | 1/1977 | Canada | 28/151 |

*Primary Examiner*—Andrew M. Falik
*Attorney, Agent, or Firm*—Michael I. Kroll

[57] ABSTRACT

A worn look carpet weave for an oriental rug consists of a plurality of warp threads that run vertical on two levels, one directly behind the other. A plurality of ground weft threads run horizontal between the two levels of the warp threads, so as to be utilized as a strong foundation for the oriental rug. A plurality of decorative weft-wrapping brocading threads run horizontal, with each looping successively about a group of two of the warp threads on the two levels making a continuous chain structure. The decorative weft-wrapping brocading threads alternates with the ground weft threads, so as to form a very fine tightly made oriental rug.

5 Claims, 1 Drawing Sheet

WORN LOOK CARPET WEAVE

BACKGROUND OF THE INVENTION

1. Field of the Invention

The instant invention relates generally to oriental rugs and more specifically it relates to an worn look carpet weave for an oriental rug, that looks and feels like an antique evenly worn oriental rug.

2. Description of the Prior Art

Numerous oriental rugs have been provided in prior art that are adapted to be of two basic types. One is a pile-knotted type, while the other is a flat-weave type. The pile-knotted type can utilize one of two different kinds of knots, which are called Turkish/Ghiordes and Persian/Senneh. The flat weave type can be of two different techniques. The Kilim technique is a weft-faced plain-weave tapestry textile. The Sumak technique is a weft-wrapping brocading textile. While these units may be suitable for the particular purpose to which they address, they would not be as suitable for the purposes of the present invention as heretofore described.

SUMMARY OF THE INVENTION

A primary object of the present invention is to provide a worn look carpet weave for an oriental rug that has a look of a pile carpet on which the entire pile has been worn to the foundation leaving the knots in its original color and design.

Another object is to provide a worn look carpet weave for an oriental rug that is the flat-weave type utilizing a decorative weft-wrapping threads brocading in conjunction with warp threads that are on two levels, one directly behind the other, so as to form a very fine tightly made rug.

An additional object is to provide an worn look carpet weave for an oriental rug in which the decorative weft-wrapping threads are made of colored wool which carry the design of the rug, while ground weft threads that run between the two levels of warp threads and alternate with the decorative weft-wrapping threads are used for the foundation of the rug.

A further object is to provide an worn look carpet weave for an oriental rug that is simple and easy to use.

A still further object is to provide an worn look carpet weave for an oriental rug that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
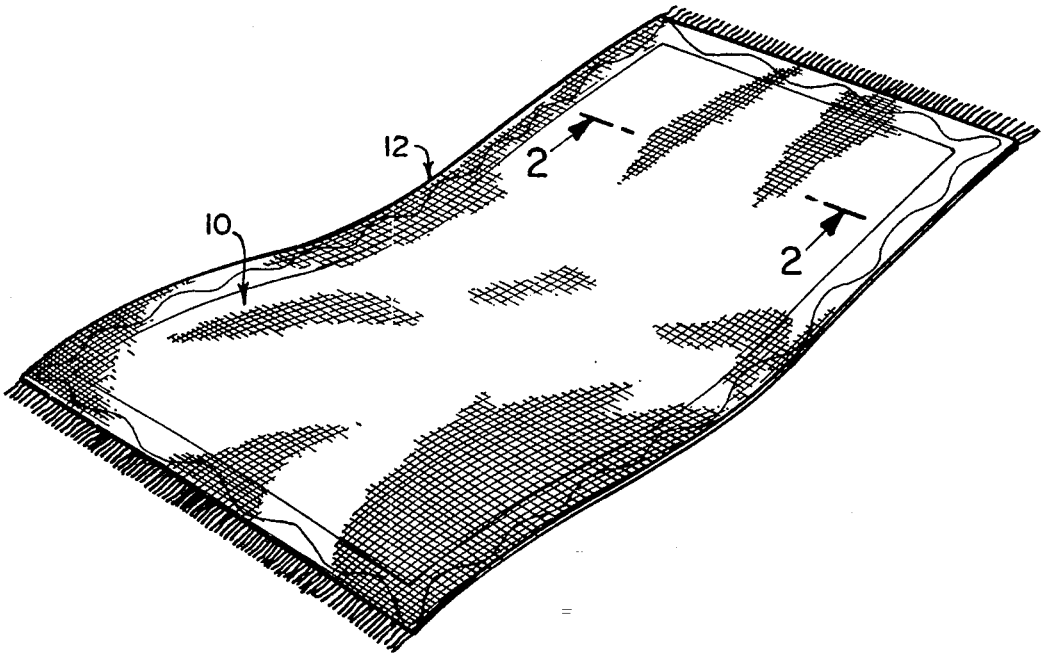
FIG. 1 is a perspective view of an oriental rug incorporating the instant invention therein.
Figure 2:
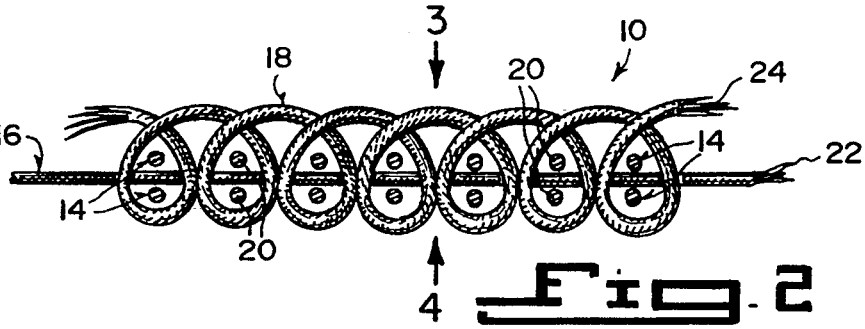
FIG. 2 is an enlarged cross sectional top view taken along line 2—2 in FIG. 1, showing the various threads of the weave.
Figure 3:
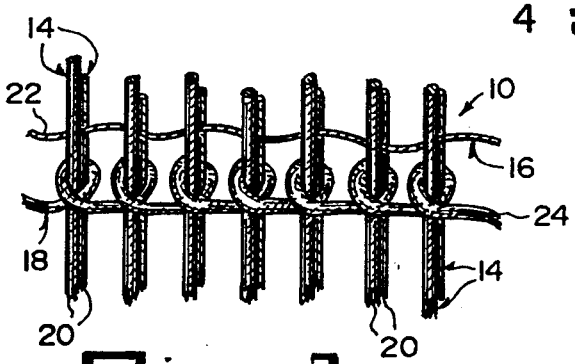
FIG. 3 is a rear view taken in direction of arrow 3 in FIG. 2.
Figure 4:
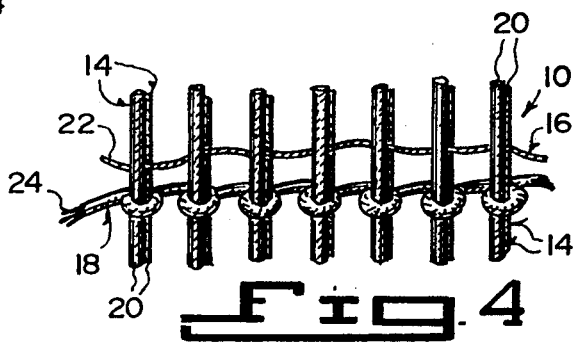
FIG. 4 is a front view taken in direction of arrow 4 in FIG. 2.

Turning now descriptively to the drawings, in which similar reference characters denote similar elements throughout the several views, the Figures illustrate an worn look carpet weave 10 for an oriental rug 12, which consists of a plurality of warp threads 14 that run vertical on two levels, one directly behind the other. A plurality of ground weft threads 16 run horizontal between the two levels of the warp threads 14, so as to be utilized as a strong foundation for the oriental rug 12.

A plurality of decorative weft-wrapping brocading threads 18 run horizontal, with each looping successively about a group of two of the warp threads 14 on the two levels making a continuous chain structure. The decorative weft-wrapping brocading threads 18 alternates with the ground weft threads 16, so as to form a very fine tightly made oriental rug 12.

Each warp thread 14 is fabricated out of durable strong strands 20, typically but not limited to wool, cotton and silk. Each ground weft thread 16 is also fabricated out of durable strong strands 22, typically but not limited to wool, cotton and silk.

Each decorative weft-wrapping brocading thread 18 is fabricated out of colored durable strong strands 24, typically but not limited to wool, cotton and silk, which carry the design of the oriental rug 12.

To produce the worn look carpet weave 10 for the oriental rug 12 consists of the following steps should be taken:

1. Position a plurality of warp threads 14, vertically on two separate levels each one behind the other.
2. Weave horizontally between the two levels of the warp threads 14, a plurality of ground weft threads 16, so as to be a strong foundation for the oriental rug 12.
3. Loop horizontally and successively about a group consisting of the plurality of vertical warp threads 14 and the plurality around weft threads 16, each of a plurality of decorative weft-wrapping brocading threads 18, forming a continuous loop configural bundled structure.
4. Alternate the decorative weft-wrapping brocading threads 18 with the ground weft threads 16 to form a very fine tightly made oriental rug 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A worn look carpet weave for an oriental rug which comprises:

a) a plurality of warp threads that run vertically on two levels, one directly behind the other;

b) a plurality of ground weft threads that run horizontally between the two levels of said warp threads, so as to be utilized as a strong foundation for the oriental rug; and c) a plurality of decorative weft-wrapping brocading threads that run horizontal, with each looping successively about a group of two of said warp threads on the two levels, making a continuous chain structure, whereby said decorative weft-wrapping brocading threads alternates with said ground weft threads, so as to form a very fine tightly made oriental rug.

2. The worn look carpet weave for an oriental rug as recited in claim 1, wherein each said warp thread is fabricated out of durable strong strands selected from the group consisting of wool, cotton and silk.

3. The worn look carpet weave for an oriental rug as recited in claim 2, wherein each said ground weft thread is fabricated out of durable strong strands selected from the group consisting of wool, cotton and silk.

4. The worn look carpet weave for an oriental rug as recited in claim 3, wherein each said decorative weft-wrapping brocading thread is fabricated out of colored durable strong strands selected from the group consisting of wool, cotton and silk.

5. The method of producing a worn look carpet weave for an oriental rug comprising the steps of:

a) running vertically on two levels one behind the other, a plurality of warp threads;

b) extending horizontally between the two levels of said warp threads a plurality of ground weft threads, so sa to be a strong foundation for the oriental rug;

c) looping horizontally and successively about a group of two of said warp threads on the two levels, one of each of a plurality of decorative weft-wrapping brocading threading, to make a continuous chain structure; and d) alternating said decorative weft-wrapping brocading threads with said ground weft threads to form a very fine tightly made oriental rug.

* * * * *